US006445805B1

(12) United States Patent
Grugel

(10) Patent No.: US 6,445,805 B1
(45) Date of Patent: Sep. 3, 2002

(54) HEARING AID ASSEMBLY

(75) Inventor: Richard N. Grugel, Owens Cross Roads, AL (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 0 days.

(21) Appl. No.: 09/923,261

(22) Filed: Aug. 6, 2001

(51) Int. Cl.[7] ..... H04R 25/00

(52) U.S. Cl. ..... 381/330; 381/322; 381/370; 181/129

(58) Field of Search ..... 381/309, 322, 381/327, 328, 330, 71.6, 370, 371, 373, 374, 380, 381, 376, FOR 149, FOR 150, 372; 181/129, 130, 135, 20; 379/430; 2/209

(56) References Cited

U.S. PATENT DOCUMENTS

| | | | | |
|---|---|---|---|---|
| 4,349,081 A | | 9/1982 | Pepple | |
| 4,375,019 A | | 2/1983 | Harada | |
| 4,437,538 A | * | 3/1984 | Ohlsson et al. | 181/129 |
| 4,869,339 A | | 9/1989 | Barton | |
| 5,002,151 A | | 3/1991 | Oliveira et al. | |
| 5,249,001 A | | 9/1993 | Jannard | |
| 5,357,585 A | | 10/1994 | Kumar | |
| 5,551,090 A | * | 9/1996 | Thompson | 181/129 |
| 5,764,778 A | | 6/1998 | Zurek | |
| 5,887,286 A | * | 3/1999 | Waldron | 381/370 |
| 6,035,961 A | | 3/2000 | Sun | |
| 6,077,237 A | | 6/2000 | Campbell et al. | |
| 6,091,832 A | | 7/2000 | Shurman et al. | |

FOREIGN PATENT DOCUMENTS

| | | | |
|---|---|---|---|
| GB | 2311186 | * | 9/1997 |

* cited by examiner

*Primary Examiner*—Huyen Le
(74) *Attorney, Agent, or Firm*—James J. McGroary

(57) ABSTRACT

Progress in hearing aids has come a long way. Yet despite such progress hearing aids are not the perfect answer to many hearing problems. Some adult ears cannot accommodate tightly fitting hearing aids. Mouth movements such as chewing, talking, and athletic or other active endeavors also lead to loosely fitting ear molds. It is well accepted that loosely fitting hearing aids are the cause of feedback noise. Since feedback noise is the most common complaint of hearing aid wearers it has been the subject of various patents. Herein a hearing aid assembly is provided eliminating feedback noise. The assembly includes the combination of a hearing aid with a headset developed to constrict feedback noise.

9 Claims, 1 Drawing Sheet

HEARING AID ASSEMBLY

STATEMENT REGARDING FEDERALLY-SPONSORED RESEARCH OR DEVELOPMENT

The invention described in this patent was made by an employee of the United States Government and may be manufactured and used by or for the Government for governmental purposes without the payment of any royalties.

CROSS-REFERENCE TO A RELATED APPLICATION

There are no applicant related applications.

BACKGROUND OF THE INVENTION

1. Field of the Invention

It is generally accepted that only about ten per cent of all hearing loss patients can be helped by medical means. The remaining approximately ninety per cent, whose condition is not medically treatable, must turn for help to hearing aids. This invention, in one of its broader aspects, relates to such hearing aids. In a more specific aspect the invention relates to hearing devices for infants and children, disabled people, and also for adults who utilize hearing aids. Even more specifically the invention provides a hearing assembly whose object is to overcome the common and irritating problem of hearing aid feedback noise.

2. Background Information

Hearing aids allow patients to hear and understand speech better in most listening situations, especially those involving high pitched speech sounds. They are particularly helpful in situations that are difficult or dangerous. Even users who have profound hearing loss have been helped by these sophisticated electronic devices. Hearing aids are used in the non-medical treatment of hearing loss. Hence they are not true prosthetic devices. They do not replace damaged ears. They are merely aids for hearing impaired ears. Sounds from the environment, or from someone speaking, enter the hearing aid through a microphone. The microphone then converts that sound (acoustical) energy into electronic energy that is sent to an electronic circuit containing filters and amplifiers that increase the sound volume. A receiver in the ear converts the amplified electrical energy back into sound (acoustic) energy.

Hearing aids have different responses for different hearing losses. There is no such thing as a one size fits all hearing aid. It is understandable, then, that there are various types of such devices. For a more complete understanding of this invention a brief discussion of the types of hearing aids is deemed helpful. In one type, in-the-ear (ITE), the hearing aid fits completely in the outer ear filling the entire outer bowl (concha) of the ear. The hard plastic case which is placed in the ear holds the instrumentation and it can accommodate additional technical mechanisms such as dual microphones. ITE hearing aids are generally used for mild to severe hearing loss, but unfortunately they are not entirely appropriate for infants or young children, and even some active adults. Another type, the in-the-canal (ITC) hearing aid, customized to fit the size and shape of the ear canal, is also suggested only for mild or moderately severe hearing loss. Some ITC aids are so small they fill only about one-half of the concha bowl of the ear. Still another type is a completely-in-canal (CIC) hearing aid, largely concealed in the ear canal, and also recommended only for mild to moderately severe hearing loss. Finally, the behind-the-ear (BTE) device, is suitable for all types and most degrees of hearing losses. It is the most appropriate style, not only for infants and young children, but for people of all ages who are faced with hearing losses, and others who find feedback noise particularly annoying. In BTE hearing aids components are held in a case behind the ear, and the sound is transmitted via a tube through an ear mold made to fit in the ear canal.

It can be seen that the degree of hearing loss present is an important factor in the selection of the type of hearing aid, and that BTE aids generally are recommended in many cases of hearing loss, especially in infants and young children in order to acquire speech, language and social skills. In the case of severe to profound hearing loss cochlear implants are being recommended. A cochlear implant is a surgical procedure, and the decision to receive an implant involves discussions with many medical specialists and an experienced surgeon. The process is expensive, and an additional consideration is that learning to interpret the sounds created by an implant takes time, practice and the involvement of speech, language pathologists and audiologists. The cochlear implant processor/microphone assembly is now being offered in a BTE configuration. In this environment, then, the invention herein also fits particularly well to help maintain the device in place.

It can be appreciated that progress in hearing aids has come a long way. For instance, it is now possible to place more sophisticated circuitry in a smaller package. Nevertheless, despite such progress hearing aids are not the perfect answer to many hearing problems. Some adult ears cannot be fit with hearing aids securely in place because of the overall size of their ear canals, or the way their ear canals bend and turn. The small size of hearing aids also leads to loosely fitting ear molds that require frequent adjustment. Such adjustment requirements lead to loosely fitting units. Even mouth movements such as chewing, talking, and athletic or other active endeavors cause hearing aid slippage calling for necessary adjustments. Loosely fitting hearing aids are the cause of an even more formidable condition. It is well accepted that ill fitting ear molds resulting from slippage are subject to feedback noise. Feedback is an annoying, high pitched sound, often a whistle, which occurs when a hearing aid does not fit securely enough in the ear. It negates many of the benefits of hearing aids.

Feedback noise is the most common complaint of hearing aid wearers. It has, therefore been the subject of such patents as U.S. Pat. No. 4,375,016. U.S. Pat. No. 4,869,339, U.S. Pat. No. 5,002,151, as well as U.K. patent. 2,311,186, The approach in these patents has been the provision of tubes or sleeves fitting snugly over the ear mold to prevent loosening. These sleeves, however, are nevertheless capable of movement during such activities as those described hereinbefore. Lubricants have also been tried, but they too do not work well.

Hearing aids present special problems for infants, and young children. Ear molds are outgrown, and they become displaced due to their size and weight on ears of young children. In children, hearing ability is fundamental to speech development. For this reason neonatal screening is now quite widely used to look for hearing impairments. The invention herein is particularly useful when hearing problems are found in those early stages.

An object of the invention, then, is to provide a hearing aid assembly which is particularly suitable for use by infants and energetic children fitted with BTE hearing aids.

Another object is the provision of a hearing aid assembly for use by active adults with hearing losses.

Still another object of the invention is the provision of a hearing aid assembly which eliminates feedback noise.

SUMMARY OF THE INVENTION

In-the-ear hearing aids are not usually recommended for infants and young children. Their ears are too small and they are still developing. By almost constantly moving, infants and small children also are more likely to loosen their ear molds, and even remove them if feedback noise is present. By this invention a hearing aid assembly is provided eliminating feedback noise. The assembly includes the combination of a hearing aid with a feedback constricting headset. The hearing aid carries a microphone, an amplifier, and a speaker in a case to be worn behind an ear. An ear mold fitting in an ear conducts amplified sound to an eardrum. The feedback constricting headset includes a compress, a pressure plate, and a headband. The compress is a soft compressible pad that is sized to cover the ear concha in order to obstruct incoming external noise. The compress is shaped to press on the ear mold when the soft material is depressed. The pressure plate is a thin disk. It is sufficiently rigid so that it can depress the compress when a force is applied to it. The headband is a resilient band shaped to fit over a head like music headphones. The band is adapted to hold the pressure plate over the compress, and, through its resiliency, to apply that force, urging the pressure plate inwardly. The inward force depresses the compress against the ear mold thus holding the ear mold in place.

DESCRIPTION OF THE INVENTION

U.S. Pat. No. 4,349,081 is directed to a hearing aid harness. Since it is chiefly for patients not of sufficient age to be instructed in the importance of retaining hearing aids in their proper positions the feedback problem is not dealt with. And, feedback noise would not be eliminated by a plurality of transverse straps. The straps which hold the hearing aid in the ear merely maintain the position of the hearing aid. Since there is no resiliency factor, there is no inward force on the hearing aid to maintain intimate contact between the ear canal and the hearing aid. For a better understanding of such differences the invention will now be discussed in greater detail in conjunction with the accompanying drawings.

DESCRIPTION OF PREFERRED EMBODIMENTS

Figure 1:
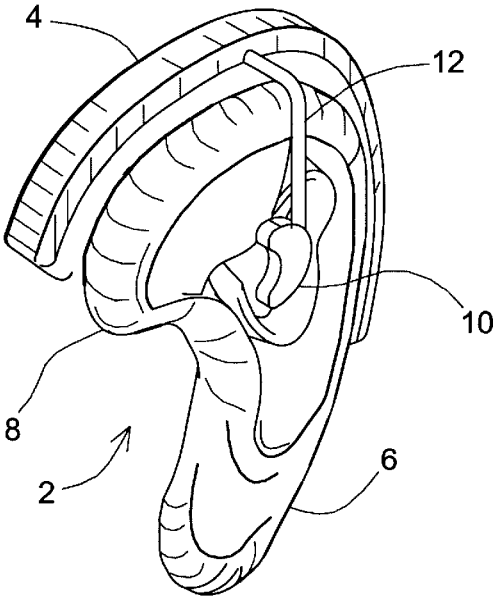
FIG. 1 is an isometric view showing an ear carrying the type of hearing aid improved herein.

As summarized hereinbefore, this invention includes a behind-the-ear (BTE) hearing aid in combination with a feedback noise constricting headset. The (BTE) hearing aid 2 is illustrated in FIG. 1. A plastic case 4 is carried by ear 6 behind its helical portion 8. The case is generally slim and fits comfortably behind the ear, following the curvature of the ear. Hearing aids all have different responses for different hearing losses. Hearing aids all make sounds louder. How hearing aids make things louder and with different responses is determined by the hearing aid circuitry. Since the circuitry within case 4 is well known, it need not be shown in the drawing. Suffice it to point out that in addition to a receiver or microphone the case can include Class A, Class B, Class D, Class H, or digital circuitry. And these circuits can be combined with any number of other circuits such as gain circuits, noise reduction circuits, input compression circuits and the like.

As shown in FIG. 1 the case containing the receiving and amplifying circuit components is connected to a flexible plastic ear mold 10 that was cast to fit inside the outer ear and ear canal. Sound thus travels through a plastic tube 12 to ear mold 10 worn inside the ear. The ear mold then transmits the amplified sound to the eardrum.

Figure 2:
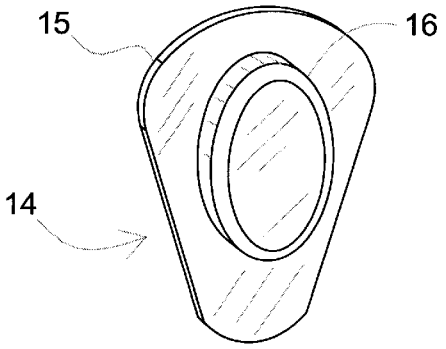
FIG. 2 is an isometric view illustrating one form of the compress of this invention.
Figure 3:
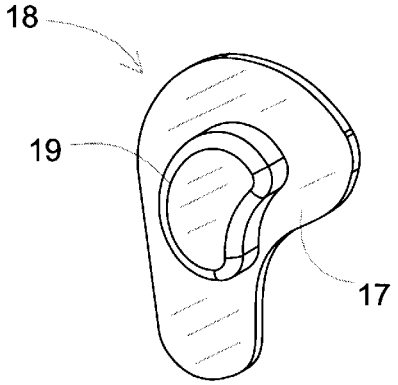
FIG. 3 is an isometric view of a preferred form of the compress of the invention.

One of the features of this invention is the use of a compress. Two such compresses 14 and 18 are depicted in FIGS. 2 and 3. The compress illustrated in FIG. 2 is essentially a flat pad 15 sized to cover most ears, with a boss portion 16 adapted to extend in the concha to hold the ear mold securely in place. The preferred form of compress is shown in FIG. 3. That compress 18 is a more or less fitted pad 17. The pad 17 is ear-shaped, and its integral boss 19 is shaped to fit in the concha holding the hearing aid.

The compress provided herein serves two purposes. In addition to depressing or constraining the ear mold, it also functions as a feedback noise barrier. Since it is sized to cover ear 6 it muffles or suppresses external sounds like earmuffs worn around aircraft and noisy machinery.

It is to be understood that preferred forms of compresses are shown in FIGS. 2 and 3, and that ordinary gauze or other cloth pads can be used. However since its chief function is to be pressed against the ear mold when depressed or squeezed, desirably it should be a spongy or rubbery pad. Since polymeric materials have made rubber virtually extinct, in more technical terms, the compress desirably will be a flexible elastomeric polymer with sponge-like (open celled) properties. Such elastomeric polymeric materials have been known for years since the initial styrene-butadiene and polyurethane elastomers came on the scene, and they can certainly be used. Preferred herein, however, are the more recently developed open-celled, visco-elastic plastics such as atactic polystyrene. A visco-elastic plastic is a polymer that responds to mechanical stresses as if it was a combination of an elastic solid and a viscous liquid. It does not remain depressed.

Figure 4:
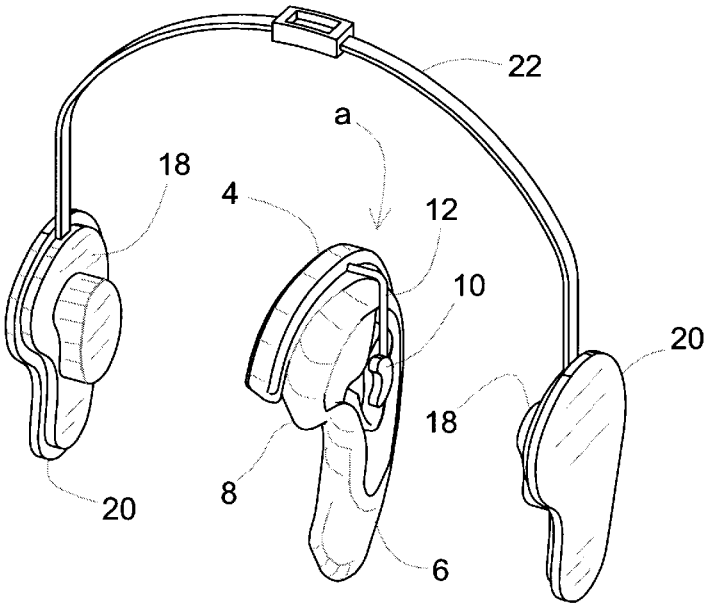
FIG. 4 is a more or less exploded view illustrating the entire invention.

An examination of FIG. 4 will show how the compress will be depressed against ear mold 10 to hold the mold securely in place to prevent feedback. This compress restraining action is accomplished by means of a pressure plate 20, one type of which is illustrated in FIG. 4. Pressure plate 20 is merely a small rigid plastic or light weight metal sheet or panel resting on top of compress 18 as shown on the left side of FIG. 4. Compress 18 can be attached to plate 20 as shown, or it can be inserted under the plate after the unit is placed over the wearer's head. Plate 20 should be slightly larger than compress 18 so that it can apply a uniform pressure over the entire compress surface when it is urged inwardly toward the ear mold. Ear mold 10 is shown in the middle portion a of the FIG. 4 drawing. To supply the force required to urge pressure plate 20 toward the ear mold 10 to squeeze compress 18, any of a number of available resilient headbands used in headsets for CD players and in other areas in the music and communication business can be readily adapted. Pressure plate 20 will be attached to each end of adjustable band 22 as shown in FIG. 4 in lieu of earphones. Headband 22, thus, can be a resilient band shaped to fit across the top of the head, or it can be a shaped band with terminal portions spring-hinged to exert the inward pressure on plates 20. Various types of headbands are described in U.S. Pat. No. 5,249,001, U.S. Pat. No. 5,357,585, U.S. Pat. No. 5,764,778, U.S. Pat. No. 6,091,832, and U.S. Pat. No. 6,077,237.

It can be seen that when hearing difficulties are discovered in infants and young children the hearing devices provided herein are especially useful. In infants and children ear mold displacement due to head movements is of particular concern. There is even more cause for concern when children are afflicted with diseases such as palsy where head movements are uncontrollable or where hand coordination, necessary to reset a loosened mold, is absent. Children and infants quickly adjust to the headband units described herein. It is well established that feedback is a result of loosened ear molds, and that such loosening can be caused even by talking and chewing. Hence, in instances wherein feedback is a major concern adults will desire the hearing aids described herein.

Figure 5:
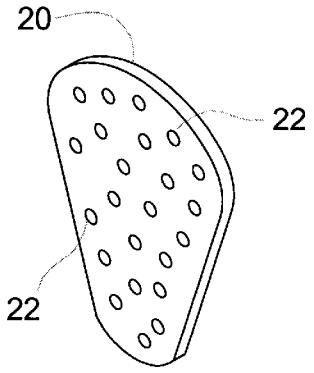
FIG. 5 is an isometric view showing one variation of this invention.

In the light of the teachings of this invention variations and ramifications will occur to those skilled in the art. As an example, in order to provide for ventilation, holes 22 in pressure plate 20 as shown in FIG. 5 or other means can be provided. Further, it has already been noted that there is a wide latitude in the selection of available types of resilient headbands. As another example, there are those who may desire the hearing aid components (the circuitry) in the stems of eyeglasses. The feedback constricting headset of this invention will be ideally suited to such eyeglass hearing aids. As another variation, additional headbands, and even chin straps can be added to the headband shown. As a further ramification circuit designs are constantly changing. These advanced digital programmable designs, for instance, adaptive compression, can be included in the case lodged behind the ear. As still another example the hearing aids can be made to work with external sound sources such as television, and, in the case of children, auditory training equipment. Finally, also for hearing aid assemblies for infants and children, the headband can be outfitted with a clip carrying a cord, the other end of which is attached to the ear mold so that it will not become soiled or lost if removed from the ear. Such modifications are deemed to be within the scope of this invention.

What is claimed is:

1. A hearing aid assembly eliminating feedback noise, the assembly comprising a hearing aid in combination with a feedback constricting headset, the hearing aid including a microphone, an amplifier, and a speaker in a case adapted to be worn behind an ear, and an ear mold adapted to fit in an ear to carry amplified sound to an eardrum, the feedback constricting headset including a compress, a pressure plate, and a headband, the compress being a soft compressible pad, sized to cover the ear concha to obstruct incoming external noise, and shaped to press, when depressed, on the ear mold, the pressure plate being a thin disk, sufficiently rigid to depress the compress, the headband being a resilient band shaped to fit a head, and adapted to hold the pressure plate over the compress with the band resiliency urging the pressure plate inwardly to depress the compress against the ear mold with a force required to hold the ear mold in place.

2. The hearing aid assembly of claim 1 wherein the compress is an open-celled elastomeric plastic pad.

3. The hearing aid assembly of claim 1 wherein the compress is an open-celled visco-elastic plastic pad.

4. The hearing aid assembly of claim 1 wherein the headband includes more than one resilient band.

5. The hearing aid assembly of claim 1 wherein the headband includes a chin strap for infants.

6. The hearing aid assembly of claim 1 wherein the headband includes additional bands in the form of straps for infant assemblies.

7. The hearing aid assembly of claim 1 wherein the compress is a plastic pad unattached to the pressure plate, adapted for insertion between the pressure plate and the ear mold.

8. The hearing aid assembly of claim 2 wherein the compress is attached to the pressure plate and carried thereby.

9. The hearing aid assembly of claim 1 wherein the pressure plate includes ventilation holes.

* * * * *